US007665475B2

(12) United States Patent
Hedstrom et al.

(10) Patent No.: US 7,665,475 B2
(45) Date of Patent: Feb. 23, 2010

(54) UTILITY SHELF FOR A DISHWASHER DISH RACK

(75) Inventors: Kristen K. Hedstrom, Humboldt, TN (US); Mark E. Palm, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 997 days.

(21) Appl. No.: 10/858,382

(22) Filed: Jun. 2, 2004

(65) Prior Publication Data

US 2005/0268945 A1 Dec. 8, 2005

(51) Int. Cl.
*B08B 3/00* (2006.01)

(52) U.S. Cl. ..... 134/134; 211/41.3; 211/41.5; 211/41.6; 211/41.8

(58) Field of Classification Search ..... 134/135; 211/41.3, 41.5, 41.6, 41.8; D32/2, 3
See application file for complete search history.

(56) References Cited

U.S. PATENT DOCUMENTS

| | | | | |
|---|---|---|---|---|
| 3,402,975 | A | 9/1968 | Smith | |
| 3,665,943 | A | 5/1972 | Lampman et al. | |
| 3,752,322 | A * | 8/1973 | Fiocca et al. | 211/41.8 |
| 3,934,728 | A | 1/1976 | Guth | |
| 4,046,261 | A * | 9/1977 | Yake | 211/41.8 |
| 4,635,799 | A | 1/1987 | Penner | |
| 4,917,248 | A | 4/1990 | Friskney | |
| 5,158,185 | A | 10/1992 | Michael et al. | |
| 5,205,419 | A | 4/1993 | Purtilo | |
| 5,344,029 | A * | 9/1994 | Oghia et al. | 211/41.8 |
| 5,351,837 | A | 10/1994 | Smith | |
| 5,431,294 | A * | 7/1995 | Stottmann et al. | 220/23.4 |
| 5,480,035 | A | 1/1996 | Smith | |
| 5,497,890 | A * | 3/1996 | Clark | 211/41.8 |
| 5,649,630 | A * | 7/1997 | Remmler | 211/41.8 |
| 2001/0040141 | A1 * | 11/2001 | Martorella et al. | 211/41.6 |
| 2002/0148494 | A1 | 10/2002 | Smith et al. | |

FOREIGN PATENT DOCUMENTS

| | | | |
|---|---|---|---|
| DE | 3417744 | | 11/1985 |
| DE | 19540610 | | 5/1997 |
| DE | 19540610 | A1 * | 5/1997 |
| DE | 19540611 | | 5/1997 |
| DE | 29621528 | * | 5/1998 |
| EP | 1005827 | | 6/1900 |
| EP | 1275336 | * | 7/2001 |
| IT | EP0855166 | * | 12/1997 |
| JP | 11206692 | | 8/1999 |
| JP | 11225939 | | 8/1999 |
| JP | 2000217769 | | 8/2000 |
| JP | 2000217769 | A * | 8/2000 |
| JP | 2001231737 | | 8/2001 |

* cited by examiner

*Primary Examiner*—Michael Cleveland
*Assistant Examiner*—Samuel A Waldbaum
(74) *Attorney, Agent, or Firm*—John W. Morrison; Diederiks & Whitelaw PLC

(57) ABSTRACT

A utility shelf includes a retaining frame pivotally connected to a support frame. The support frame is pivotally connected to a side portion of a dish rack through a plurality of hinge elements. Similarly, the retaining frame is pivotally connected to the support frame through a corresponding plurality of hinge members. The hinge members on the retaining frame are adapted to abut a stop member that positions the retaining frame at an angle relative to the support frame. With this arrangement, the retaining frame can be extended from the support frame to support objects during a washing operation.

24 Claims, 4 Drawing Sheets

UTILITY SHELF FOR A DISHWASHER DISH RACK

BACKGROUND OF THE INVENTION

1. Field of the Invention

The present invention pertains to the art of dishwashers and, more particularly, to a utility shelf including a pivoting retaining wall for mounting on a dish rack of a dishwasher.

2. Discussion of the Prior Art

In the art of dishwashers, it has typically been industry practice to design racks with dish support members arranged for loading standard dishware, such as dinner plates. Some articles, such as flatware, cannot be loaded like standard dishware, but rather require special consideration. Toward that end, manufacturers provide removable baskets for supporting flatware during a washing operation. Other articles that require special consideration include small or lightweight plastic tableware and various cooking and food preparatory utensils.

Most modern dishwashers employ a number of wash arms to deliver a high pressure spray of washing fluid onto the dishware. This high pressure spray is very effective at removing built-up soil and food from the dishware. Unfortunately, it is also effective at dislodging small and lightweight tableware arranged in a dish rack. Once dislodged, the lightweight tableware can interfere with the washing operation, such as by blocking spray arms or shielding other objects from the high pressure spray. To combat this problem, manufacturers have included snuggers and other retaining members to hold the lightweight articles on a rack.

Cooking and food preparatory utensils also require special consideration. Too large to be accommodated by the flatware baskets, consumers typically lay the utensils on the dish rack or on the retaining member used to hold the lightweight tableware in the dish rack. In either case, like the lightweight tableware, the utensils can dislodged during a washing operation. To address this concern, certain manufactures include removable utensil baskets with their dishwashers. However, the baskets take up valuable space and, since they are not always necessary, they are removed from the dishwasher and often times lost or misplaced.

Based on the above, there exists a need in the art for a utility shelf that can support utensils and other items not suited for a standard flatware basket in a dishwasher. More specifically, there exists a need for a utility shelf that does not take up valuable space and yet remains an integral part of a dish rack.

SUMMARY OF THE INVENTION

The present invention is directed to a utility shelf having a retaining frame pivotally connected to a support frame within a dishwasher. More specifically, the dishwasher includes a rack including a bottom support and a peripheral wall extending substantially perpendicularly from the bottom support. The rack is constituted by a plurality of longitudinally and laterally extending members. The support frame is secured to the rack through a plurality of hinge elements that snap-fit onto one or more of the rack forming members. In one preferred form, the rack is formed from a plurality of coated wires. However, other types of racks, such as preformed plastic racks, are equally acceptable.

In accordance with the most preferred form of the invention, the support frame includes plurality of longitudinally and laterally extending web members that define a support surface, with the plurality of hinge elements being formed on one of the web members. Once mounted, the support frame is adapted to be rotated from a first position, wherein the support frame rests against one of the peripheral wall portions of the rack, to a second position, wherein the support frame extends substantially perpendicularly from the peripheral wall portion of the rack.

In further accordance with the most preferred form of the invention, the retaining frame is pivotally secured to the support frame. More specifically, the retaining frame is formed from a plurality of longitudinally and laterally extending fence members that collectively define a combination retaining and supporting surface. The retaining frame also includes a hinge member sized to attach to one of the web members of the support frame. With this arrangement, the retaining frame can rotate from a first position, wherein the retaining frame rests against the support frame, to a second position, wherein the retaining frame is angled, such as at approximately a 160° angle, relative to the support frame. Preferably, the retaining frame is nested within the support frame when not in use to enable the support frame to lie flush against the peripheral wall portion.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
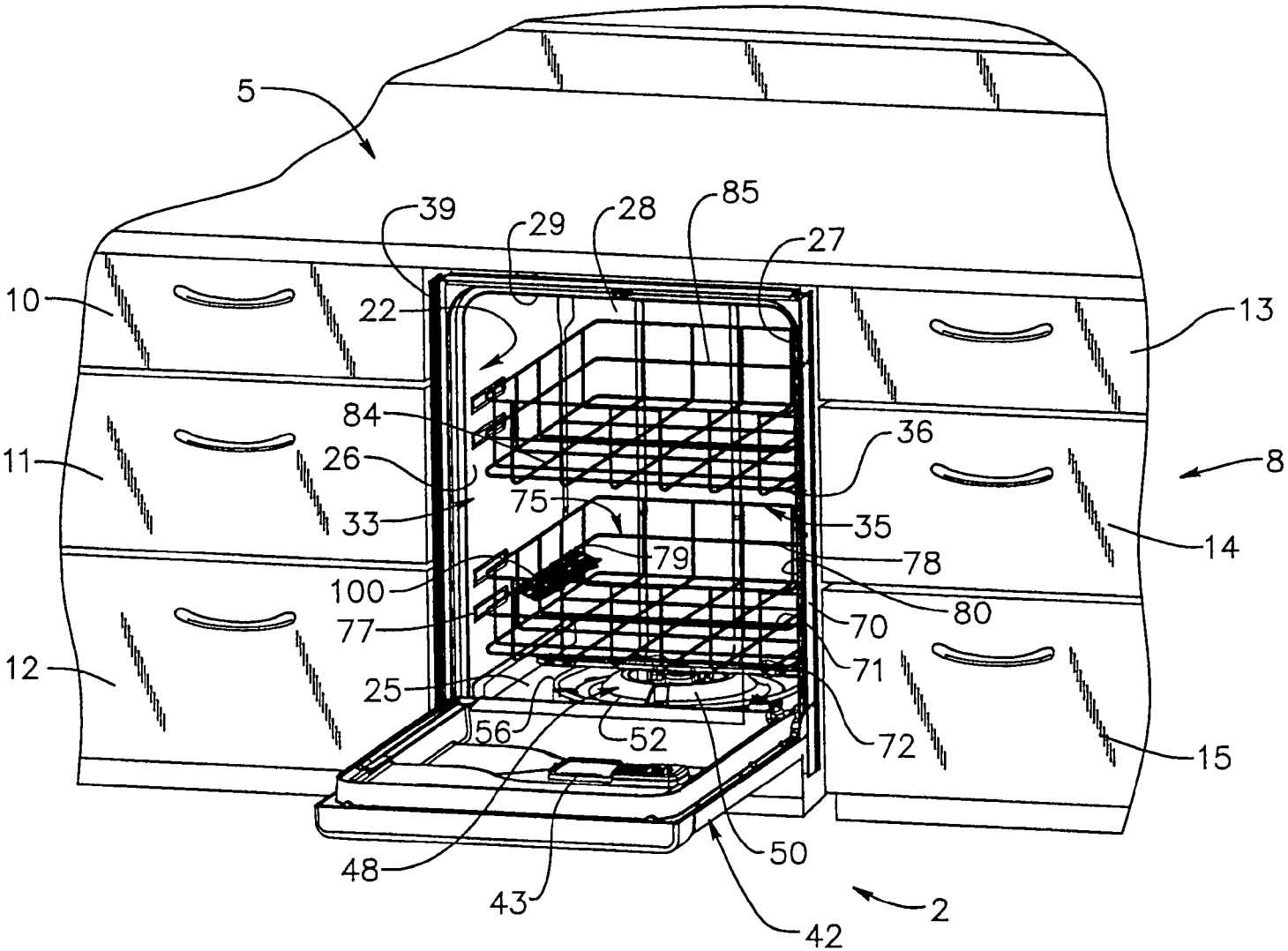
FIG. 1 is an upper right perspective view of a dishwasher including a utility shelf constructed in accordance with the present invention mounted to a dish rack arranged within the dishwasher.
Figure 2:
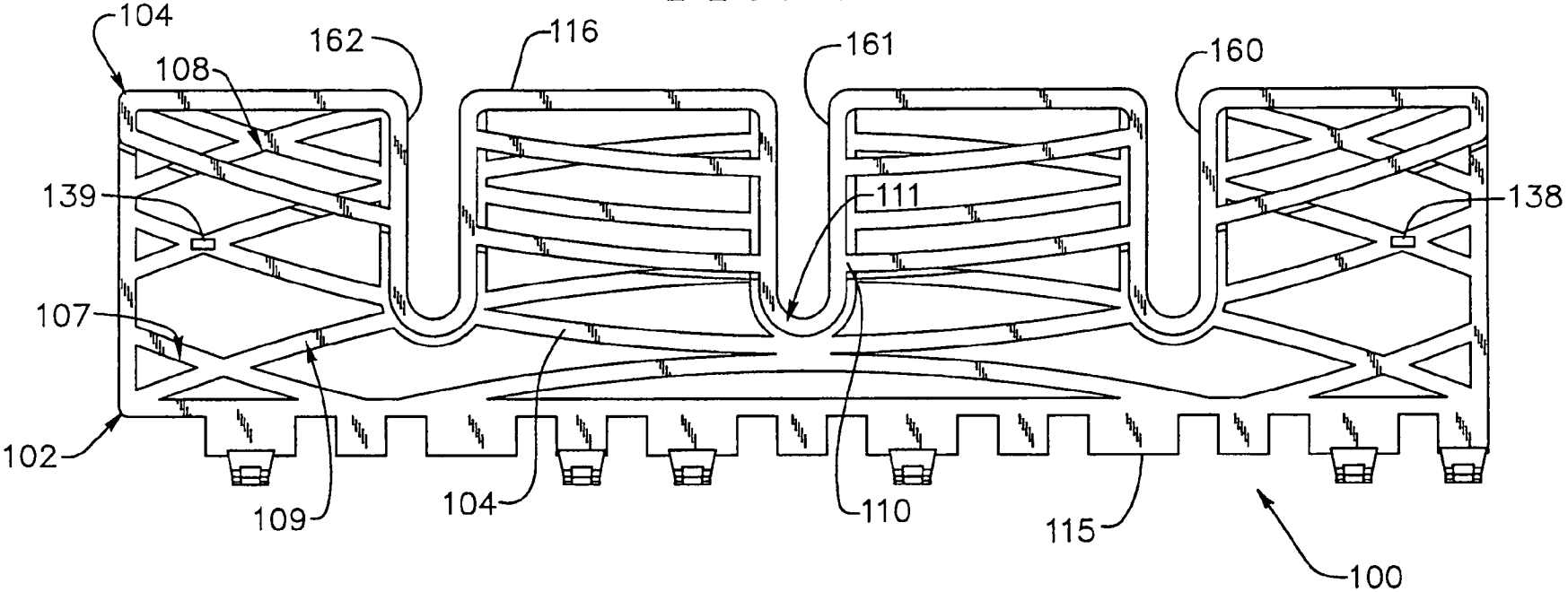
FIG. 2 is a top plan view of the utility shelf constructed in accordance with the present invention.

With initial reference to FIG. 1, a dishwasher 2 is generally indicated to be positioned below a kitchen countertop 5. Also below kitchen countertop 5 is shown cabinetry 8 including a plurality of drawers 10-15 for storing various items. Dishwasher 2 includes a tub 22 that is preferably injection molded of plastic so as to include integral bottom, side, rear and top walls 25-29 respectively. Within the confines of walls 25-29, tub 22 defines a washing chamber 33 within which soiled kitchenware is adapted to be placed upon shiftable lower and upper racks 35 and 36 to undergo a washing operation in a manner widely known in the art. Tub 22 has attached thereto a frontal frame 39 which pivotally supports a door 42 used to seal chamber 33 during the washing operation. In connection with the washing operation, door 42 is preferably provided with a detergent tray or cup assembly 43 into which a consumer can place liquid or particulate washing detergent for dispensing at predetermined portions of the washing operation. Of course, dispensing detergent in this fashion is widely known in the art such that this arrangement is only being described for the sake of completeness.

Disposed within tub 22 and, more specifically, mounted within a central opening (not separately labeled) formed in bottom wall 25 of tub 22, is a pump assembly 48. In the embodiment illustrated, pump assembly 48 includes a main housing 50, an annular, radial outermost strainer 52 and a filter guard (not separately labeled). Extending about a substantial portion of pump assembly 48, at a position raised above bottom wall 25, is a heating element 56. In a manner known in the art, heating element 56 preferably takes the form of a sheathed, electric resistive-type heating element. The exact structure and operation of pump assembly 48 does not constitute part of the present invention and therefore will not be described in greater detail. However, for a detailed description of pump assembly 48, as well as a particular method of operation, reference is made to U.S. patent application Ser. No. 10/186,739 now U.S. Pat. No. 7,146,992 herein entitled "Dishwasher Pump and Filtration System" which is herein incorporated by reference.

As further illustrated in FIG. 1, lower dish rack 35 includes a bottom support 70 having a plurality of longitudinal and lateral wire members 71 and 72, and a peripheral wall 75 including front, rear, and opposing side wall portions 77-80. In a similar manner, upper rack 36 includes a bottom support 84 and a peripheral wall 85. In a manner known in the art, lower and upper racks 35 and 36 are provided with a plurality of upwardly projecting tines (not separately labeled) for supporting kitchenware within tub 22 during washing operations. In general, the structure described above is provided for the sake of completeness as the present invention is particularly directed to a utility shelf 100 removably secured to lower and/or upper dish racks 35 and 36. Also, although dishwasher 2 is shown to include door 42 which pivots about a lower horizontal axis, it should be understood that utility shelf 100 could be incorporated in other types of dishwasher units, including drawer-type dishwashers.

As best seen in FIGS. 2-5, utility shelf 100 includes a support frame member 102 and a retaining frame member 104. As shown, support frame member 102 includes a plurality of longitudinally and laterally extending web members (not separately labeled) that collectively define a stepped support surface 107 having upper and lower stages or plateaus 108 and 109. Likewise, retaining frame member 104 includes a plurality of longitudinally and laterally extending fence members 110 that combine to form a retaining and supporting surface 111.

Figure 3:
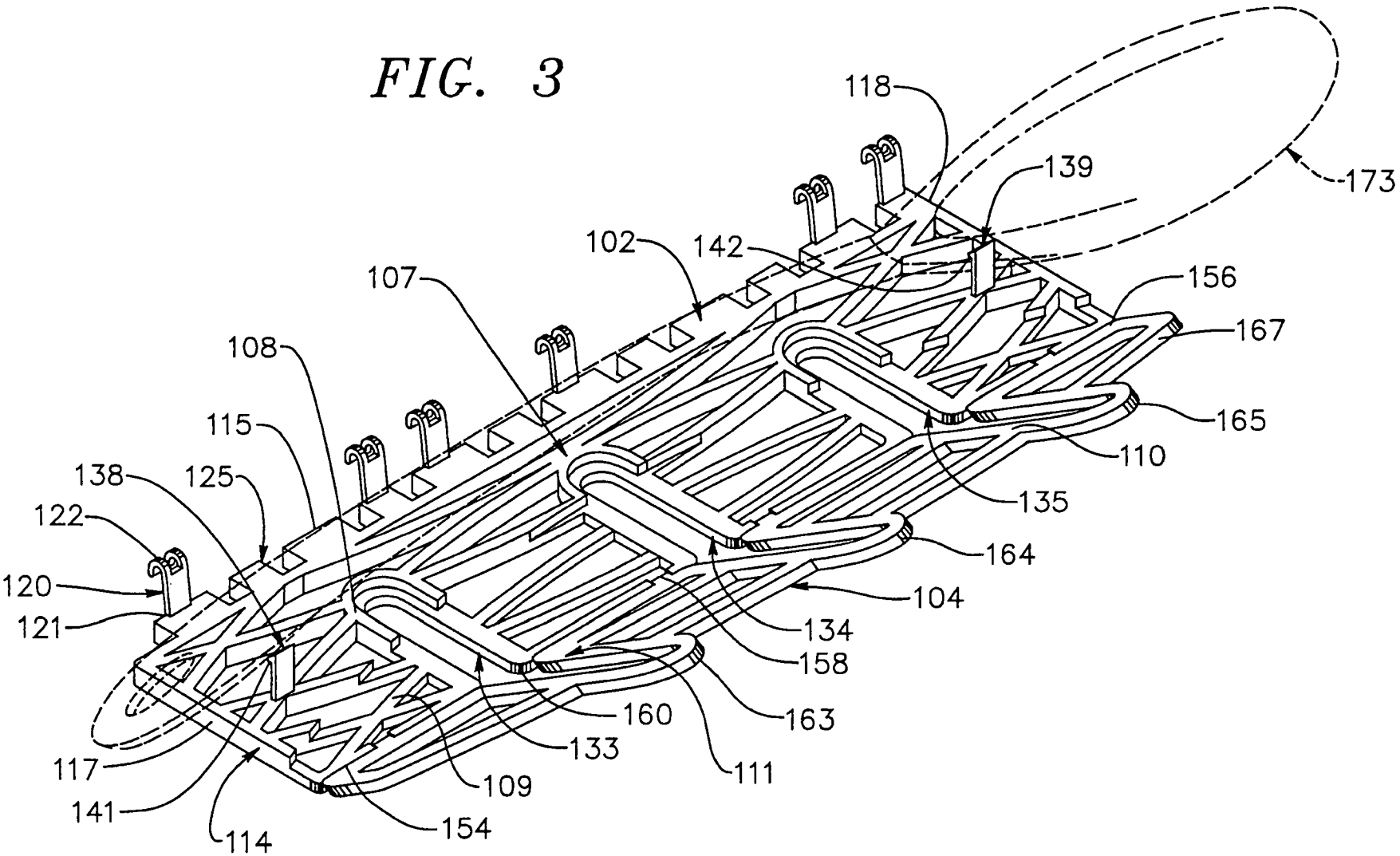
FIG. 3 is a upper right perspective view of the utility shelf of the present invention depicted in an open position supporting a utensil shown in phantom.
Figure 5:
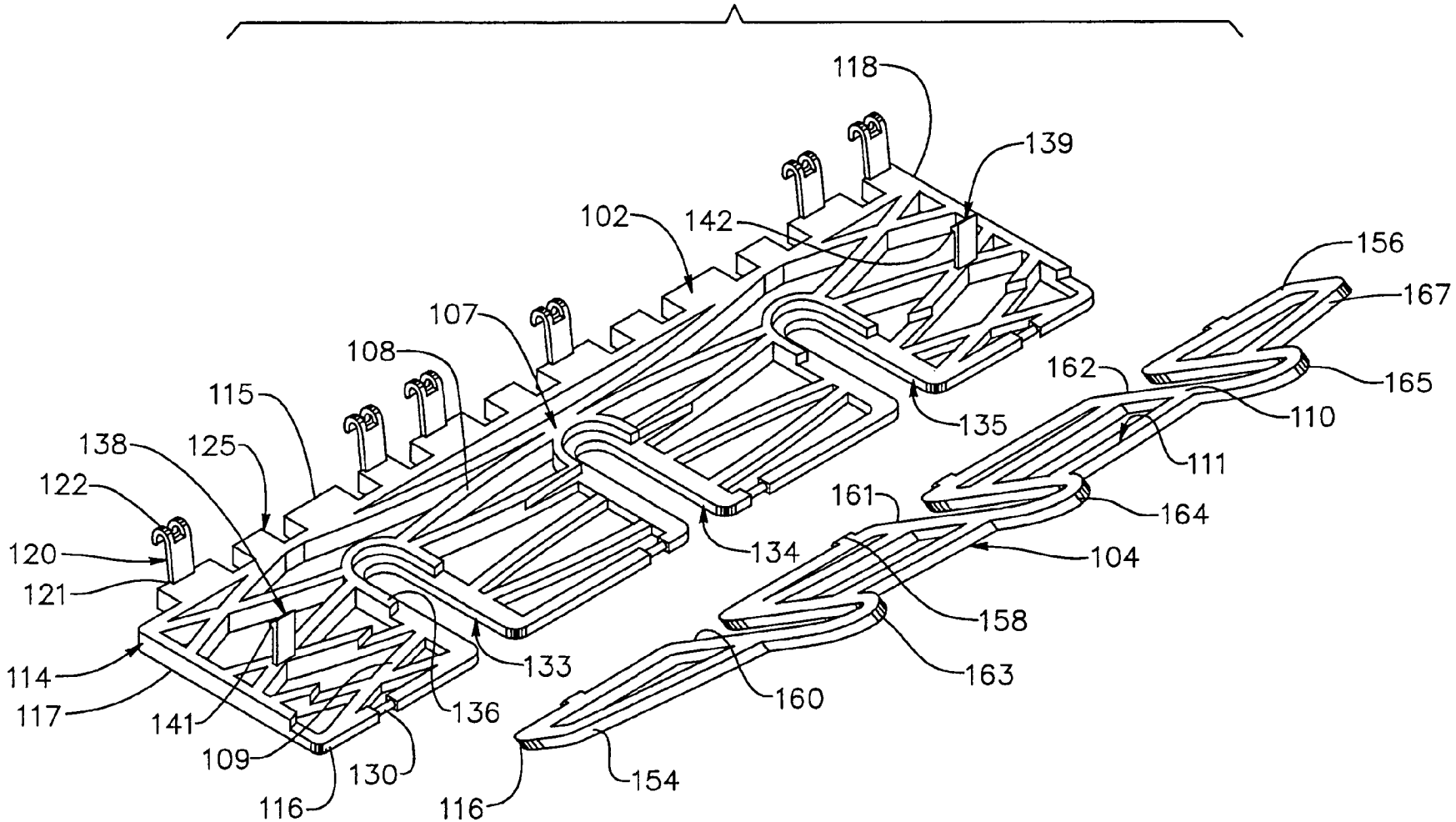
FIG. 5 is an exploded view of the utility shelf of FIG. 3.

As best seen in FIGS. 3 and 5, support frame member 102 includes a peripheral edge portion 114 having a first longitudinal side 115, a second, opposing longitudinal side 116, and opposing lateral side members 117 and 118 which surround stepped support surface 107. Arranged along first longitudinal side 115 of support frame member 102 are a plurality of hinge members, one of which is indicated at 120. Each hinge member 120 includes a first end 121 projecting from peripheral edge portion 114 and extending to a second end that terminates in a hook-like element 122. Also arranged along first longitudinal side 115 of support frame member 102 are a plurality of notches or grooves 125 which, as will be discussed more fully below, enable utility shelf 100 to seat against and extend from one of peripheral wall portions 75 and 85 of lower and upper dish racks 35 and 36 respectively.

As best illustrated in FIG. 5, arranged along second longitudinal side 116 of support frame member 102 are a plurality of hinge receiving lands, one of which is indicated at 130. As will be detailed more fully below, hinge receiving lands 130 are employed to interconnect with retaining frame member 104. Also shown along second longitudinal side 116 are a plurality of U-shaped recesses 133-135 which extend inwardly from second longitudinal side 116 toward first longitudinal side 115 through supporting surface 107. In accordance with the most preferred form of the invention, a portion of each U-shaped recess 133-135, as well as a portion of support surface 107, is defined by a raised section 136 that extends in a plane offset from lower stage 109, but which is preferably co-planar with upper stage 108. In further accordance with the most preferred form of the invention, projecting perpendicularly from upper stage 108 are first and second tab members 138 and 139. First and second tab members 138 and 139 terminate in a hook-like end portions 141 and 142 for engaging respective portions (not separately labeled) of lower or upper dish racks 35, 36. More specifically, tab members 138 and 139 are provided to secure utility shelf 100 against a respective side portion 75, 85 of lower or upper dish rack 35, 36 respectively, when utility shelf 100 is placed in an upright, non-use or storage position.

In a manner similar to that described above with specific reference to FIGS. 3 and 5, fence members 110 of retaining frame member 104 are surrounded by a peripheral edge portion 154. Arranged along a first portion 156 of peripheral edge 154 are a plurality of hinge members, one of which is indicated at 158. Each hinge member 158 is adapted to snap-fittingly engage onto a respective hinge receiving land 130 of support frame member 102. As will be discussed more fully below, each hinge member 158 defines a respective stop member 159 (see FIG. 4) for maintaining retaining frame member 104 in an open position. Also shown extending along first edge 156 are a plurality of U-shaped recesses 160-162 which actually define an associated plurality of finger elements 163-165 that project from a second portion 167 of peripheral edge 154. With this arrangement, retaining frame member 104 can nest into lower stage 109, with finger elements 163-165 being at least partially surrounded by raised sections 136, so as to be coplanar with upper stage 108 in order to maintain a thin profile for utility shelf 100.

Figure 4:
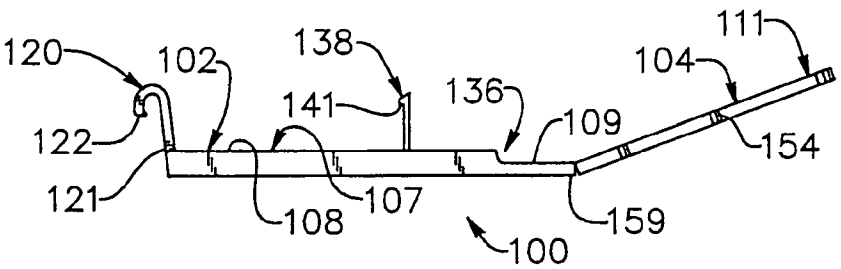
FIG. 4 is a right side elevational view of the utility shelf of FIG. 3.

Having described a preferred construction of utility shelf 100, a brief description of a preferred method of operation will be described with particular reference to FIGS. 1, 4 and 5. As best seen in FIG. 1, utility shelf 100 is shown snap-fittingly engaging a peripheral wall 75 of lower rack 35 through hinge members 120. In accordance with one aspect of the present invention, utility shelf 100 is adapted to be rotated from a first position, wherein utility shelf 100 extends substantially parallel to peripheral wall 75 while being secured to lower rack 35 by tab members 138 and 139, to a second position extending substantially perpendicularly from peripheral wall 75, with notches 125 accommodating various wire members of lower rack 35 as shown in FIG. 1. When placed in the second position, utility shelf 100 is adapted to receive kitchenware, such as a utensil as generally indicated at 173 in FIG. 3. In accordance with another aspect of the present invention, in order to more securely receive utensil 173, retaining frame member 104 is rotated from a first position, wherein finger elements 163-165 nest along U-shaped recesses 133-135, to a second position, wherein retaining frame member 104 projects at an angle from support frame member 102. In accordance with the most preferred form of the invention, retaining frame member 104 is maintained at an angle, e.g., approximately 160° from support surface 107 through stop members 159. In this manner, a consumer is able to place large utensils, including stirring spoons, spatulas, and the like, within washing chamber 33 without fear that the utensil will be dislodged from a respective lower or upper rack 35, 36. In addition, the present invention enables the consumer to suspend utensils, which are typically difficult to accommodate in a kitchenware basket, in an easily operated utility shelf 100 provided in dishwasher 2.

Although described with reference to a preferred embodiment of the present invention, it should be readily apparent to one of ordinary skill in the art that various changes and/or modifications can be made to the invention without departing from the spirit thereof. For instance, while a single utility shelf is shown provided in the dishwasher, a plurality of utility shelves can be secured to either or both of the dish racks. Also, the disclosed angle at which the retaining frame member projects from the support frame is but one preferred example, and it should be understood that various other angles could be readily established, such as by enabling variable detent positions for the retaining frame member. In general, the invention is only intended to be limited by the scope of the following claims.

We claim:

1. A dishwasher comprising:

a tub defining a washing chamber;

a rack including a bottom support and a peripheral wait extending from the bottom support, said rack being adapted to support objects within the washing chamber; and a utility shelf removably secured to the rack for supporting objects during operation of the dishwasher, said utility shelf including:

a support frame defining a support surface, said support frame being adapted to rotate from a first position, wherein the support frame rests along the peripheral wall, to a second position, wherein the support frame extends away from the peripheral wall;

a retaining frame attached to the support frame, said retaining frame being adapted to shift relative to the support frame from a first position, wherein the retaining frame extends adjacent the support frame, to a second position, wherein the retaining frame extends at an angle from the support frame for supporting objects during operation of the dishwasher; and a stop member acting directly between the support frame and the retaining frame to maintain the angle between the retaining frame and the support frame when the retaining frame is in the second position.

2. The dishwasher according to claim 1, wherein the retaining frame is pivotally attached to the support frame such that the retaining frame is rotatable between the first and second positions.

3. The dishwasher according to claim 1, wherein the retaining frame includes a plurality of longitudinally and laterally extending fence members surrounded by a peripheral edge portion, said longitudinally and laterally extending fence members defining a combination retaining and support surface.

4. The dishwasher according to claim 1, wherein the support frame includes a plurality of longitudinally and laterally extending web members surrounded by a peripheral edge, said plurality of longitudinally and laterally extending web members defining the support surface.

5. The dishwasher according to claim 4, wherein the support frame includes a plurality of hinge members spaced along a first length of the peripheral edge and a plurality of hinge receiving lands spaced along a second, opposing length of the peripheral edge.

6. The dishwasher according to claim 5, wherein the plurality of hinge members of the support frame are snap-fittingly attached to the rack.

7. The dishwasher according to claim 5, wherein the retaining frame includes a plurality of hinge members, said hinge members being snap-fittingly engaged with the hinge receiving lands of the support frame.

8. The dishwasher according to claim 1, wherein the support frame includes a plurality of laterally extending fingers.

9. The dishwasher according to claim 1, wherein the support frame includes at least one tab member adapted to engage the rack to retain the support frame in the first position.

10. The dishwasher according to claim 1, wherein the retaining frame nests with the support frame when in the first position.

11. The dishwasher according to claim 1, wherein a plurality of notches are arranged along a longitudinally extending side of the support frame, said plurality of notches accommodating the rack when the support frame is in the second position.

12. The dishwasher according to claim 1, wherein the retaining frame extends at an angle of approximately 160 degrees from the support frame when in the second position.

13. A utility shelf removably secured to a rack in a dishwasher comprising:

a support frame defining a support surface, said support frame being adapted to rotate from a first position, wherein the support frame is adapted to rest along a peripheral wall of a dishwasher rack, to a second position, wherein the support frame extends away from the peripheral wall;

a retaining frame attached to the support frame, said retaining frame being adapted to shift relative to the support frame from a first position, wherein the retaining frame extends adjacent the support frame, to a second position, wherein the retaining frame extends at an angle from the support frame for supporting objects during a dishwashing operation; and a stop member acting directly between the support frame and the retaining frame to maintain the angle between the retaining frame and the support frame when the retaining frame is in the second position.

14. The utility shelf according to claim 13, wherein the retaining frame is pivotally attached to the support frame such that the retaining frame is rotatable between the first and second positions.

15. The utility shelf according to claim 13, wherein the retaining frame includes a plurality of longitudinally and laterally extending fence members surrounded by a peripheral edge portion, said longitudinally and laterally extending fence members defining a combination retaining and support surface.

16. The utility shelf according to claim 13, wherein the support frame includes a plurality of longitudinally and laterally extending web members surrounded by a peripheral edge, said plurality of longitudinally and laterally extending web members defining the support surface.

17. The utility shelf according to claim 16, wherein the support frame includes a plurality of hinge members spaced along a first length of the peripheral edge and a plurality of hinge receiving lands spaced along a second, opposing length of the peripheral edge.

18. The utility shelf according to claim 17, wherein the plurality of hinge members of the support frame are adapted to be snap-fittingly attached to a dishwasher rack.

19. The utility shelf according to claim 17, wherein the retaining frame includes a plurality of hinge members, said hinge members being snap-fittingly engaged with the hinge receiving lands of the support frame.

20. The utility shelf according to claim 13, wherein the support frame includes a plurality of laterally extending fingers.

21. The utility shelf according to claim 13, wherein the support frame includes at least one tab member adapted to engage a dishwasher rack to retain the support frame in the first position.

22. The utility shelf according to claim 13, wherein the retaining frame nests with the support frame when in the first position.

23. The utility shelf according to claim 13, wherein a plurality of notches are arranged along a longitudinally extending side of the support frame, said plurality of notches accommodating a dishwasher rack when the support frame is in the second position.

24. The utility shelf according to claim 13, wherein the retaining frame extends at an angle of approximately 160 degrees from the support frame when in the second position.

* * * * *

UNITED STATES PATENT AND TRADEMARK OFFICE

CERTIFICATE OF CORRECTION

PATENT NO. : 7,665,475 B2
APPLICATION NO. : 10/858382
DATED : February 23, 2010
INVENTOR(S) : Hedstrom et al.

It is certified that error appears in the above-identified patent and that said Letters Patent is hereby corrected as shown below:

Column 5, line 32 (Claim 1, line 3) the word "wait" should be --wall--.

Signed and Sealed this

Twelfth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,665,475 B2
APPLICATION NO. : 10/858382
DATED : February 23, 2010
INVENTOR(S) : Hedstrom et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1585 days.

Signed and Sealed this

Seventh Day of December, 2010

David J. Kappos

David J. Kappos
*Director of the United States Patent and Trademark Office*